US005085812A

United States Patent [19]

Ahrweiler et al.

[11] Patent Number: 5,085,812

[45] Date of Patent: Feb. 4, 1992

[54] METHOD OF AND PLANT FOR THE MANUFACTURE OF WOOD CHIPBOARDS AND SIMILAR BOARD MATERIALS

[75] Inventors: Karl-Heinz Ahrweiler, Willich; Bernd Heimes, Munchen-Gladbach, both of Fed. Rep. of Germany

[73] Assignee: Eduard Küsters Maschinenfabrik GmbH & CO KG, Krefeld, Fed. Rep. of Germany

[21] Appl. No.: 408,507

[22] PCT Filed: Feb. 11, 1988

[86] PCT No.: PCT/DE88/00064

§ 371 Date: Aug. 16, 1989

§ 102(e) Date: Aug. 16, 1989

[87] PCT Pub. No.: WO88/06082

PCT Pub. Date: Aug. 25, 1988

[30] Foreign Application Priority Data

Feb. 17, 1987 [DE] Fed. Rep. of Germany ..... 3704940

[51] Int. Cl.[5] ..... B30B 5/06

[52] U.S. Cl. ..... 264/37; 264/40.1; 264/109; 264/113; 425/135; 425/217; 425/371

[58] Field of Search ..... 264/37, 109, 113, 112, 264/40.1; 425/371, 217, 135

[56] References Cited

U.S. PATENT DOCUMENTS

| | | | |
|---|---|---|---|
| 2,940,135 | 6/1960 | Heritage | 264/518 |
| 3,926,542 | 12/1975 | Ahrweiler | 425/174.4 |
| 3,993,426 | 11/1976 | Ahrweiler et al. | 425/371 |
| 4,038,531 | 7/1977 | Loe | 235/151.1 |
| 4,213,748 | 7/1980 | Ahrweiler | 425/371 |
| 4,213,928 | 7/1980 | Casselbrant | 264/113 |
| 4,426,340 | 1/1984 | Goller et al. | 264/29.1 |

*Primary Examiner*—Mary Lynn Theisen
*Attorney, Agent, or Firm*—Kenyon & Kenyon

[57] ABSTRACT

In a double-belt press for the manufacture of wood chip boards and the like having a width less than the nominal working width of the double-belt press, the forming belts are held in contact with the support structure so as to ensure heat transfer in the edge portion of the pressing zone extending beyond the edge of the filling which produces the boards to the region near the edge of the pressing zone. In this edge portion, an edge filling composed of unbonded particles is compressed on a compressible rotating belt.

14 Claims, 3 Drawing Sheets

II
19
26
1
IV
2
27
4
21
21
20
II 30
42
44
26
43
45
40
41
30
1
33
32
35
31
4
36
2
30
41
45
40
27
43
21
44

METHOD OF AND PLANT FOR THE MANUFACTURE OF WOOD CHIPBOARDS AND SIMILAR BOARD MATERIALS

BACKGROUND OF THE INVENTION

This invention relates to a method and apparatus for the manufacture of wood chip boards in general and more particularly to a method and apparatus that allows for the manufacture of wood chip boards of varying width.

An apparatus for the manufacture of wood chip boards is disclosed in DE-PS 23 55 797. An apparatus of this type represents a considerable investment and it is therefore desirable not only to be able to produce boards with widths corresponding to the nominal working width of such an apparatus, but also, if necessary, boards of a smaller width. For example, board widths of 210 and 185 cm are conventional on the market. In an attempt to manufacture the smaller board width on an apparatus designed for the larger board width, the width of the filling must be made correspondingly smaller.

When this was done on apparatuses of the prior art problems occurred because the edges of the forming belts projecting out beyond the edge of the filling were not subjected to a counter-pressure and could not be adequately pressed against the support structure from which not only the pressure, but also the heat, is transmitted to the forming belts. Consequently, for the construction disclosed in DE-PS 23 55 797, the edge of the forming belts had no contact with the support structure or the rollers, which cover the entire width of the forming belts and transmit the heat from the support structure to the forming belts. As a result, the temperature of the forming belts dropped considerably near their edges. Since the wide middle zone of the forming belts was at a higher working temperature than the edge, there was considerable thermal stress, forcing the edge zone to contract longitudinally.

Such thermal stress became critical in the area of the reversing drums, because in addition to the thermal stress there were additional stresses due to the considerable longitudinal tension of the forming belts, as well as the stress resulting from the elongation of the outer fiber due to the belt reversal. The resulting total tensile stress on the outside of the zones of the forming belts wound over the reversing drums approached and in some cases exceeded, the yield stress. In either case this total tensile stress led to problems during continuous operation, particularly since the forming belts are made of stainless steel, which is not particularly resistant to repeated stress due to flexing.

Similar problems occurred in double-belt presses of the prior art even when the nominal width was used. These problems occurred because the filling did not extend to the edge of the forming belts, which projected transversely beyond the filling and also beyond the edge of the zone covered by the rollers. Here again there were temperature drops with the corresponding stresses.

In the press disclosed in DE-PS 22 43 465, an attempt was made to keep the temperature drop within certain limits by heating the projecting edges of the forming belts. However, it was found to be necessary to heat the edges of the forming belts over practically their entire length, because otherwise the temperature immediately dropped off beyond the heated zone. Heating the entire length of the forming belts, however, gave rise to considerable structural problems. For this reason, as well as because of the considerable expense, this press is generally not used.

As disclosed in DE-PS 28 19 943, another solution to the problem involved corrugating the projecting edge of the forming belts so that more material was available at the edge. Thus, in the event of a temperature drop near the edge, the longitudinal tensile stress resulting from the thermal contraction was not so great. Although this solution is practical for projecting edges of just a few centimeters in width, it is impractical if there is a temperature drop over projecting edges that are several tens of centimeters in width.

In view of the prior art, there is a need to develop a method and an apparatus of the type mentioned in the beginning so that board-producing webs of smaller width can be run on a double-belt press which has a predetermined nominal working width.

SUMMARY OF THE INVENTION

This task is accomplished by spreading an edge filling comprising unbonded particles on the edge portion of the bottom metal forming belt of a double-belt press. This edge portion extends from at least one edge of the main filling to at least one edge region of the bottom forming belt The temperature drop at the edge of the forming belts that would otherwise occur at smaller working widths because of the lack of contact between the forming belts, and the poor heat transfer to the forming belts that accompanies it, is avoided, since this contact is now produced artificially. As a result, heat still passes from the support structure to the forming belts even in the edge portion so that the temperature drop either does not occur or is at least reduced to a harmless value. The contact pressure need not be absolutely identical to the contact pressure on the middle part of the forming belts which contains the filling, although this would naturally be preferable in order to create identical conditions. It is, however, sufficient if the contact pressure is just great enough so that a temperature can be maintained which restricts the thermal stress to a tolerable value.

The contact created between the forming belts and the support structure when they are under pressure, which is necessary to ensure that the heat transfer occurs, is produced according to the invention by a simple means: namely, the particles which are already available are used. Because of the nature of these particles, this contact pressure is automatically compatible with the compression properties of the filling in the middle zone. The particles for the edge filling should be free from binder, because otherwise they would be cured and these cured edge parts of the resulting board would have to be rejected, which is as economically inefficient as manufacturing a wider board from the outset and trimming it to the required smaller width by discarding a wide edge strip.

According to the present invention, the particles for the edge filling may be supplied from the same stock as the main filling.

According to another aspect of the invention, it may be advantageous to adjust the moisture content of the particles for the edge filling independently of the moisture content of the particles for the main filling.

The reason for adjusting the two moisture content values independently of each other is that the moisture content is of decisive importance in determining the amount of heat that is withdrawn from the forming belt. The liquid contained in the particles is mostly water, which evaporates, and the heat necessary for this evaporation process comes from the forming belts. Thus, if the temperature of the edge portion of the forming belts is to be kept high, it is advantageous to ensure that a minimum amount of heat is lost in the edge portion by the evaporation of water, i.e., the particles in the edge portion should have a lower moisture content than the particles of the main filling.

If the same particles were always used for the edge filling, they would over time become spoiled and their mechanical properties would become different from the particles of the main filling.

For this reason, the method according to the invention includes a step for supplying the particles of the edge filling from the same stock as the particles of the main filling, so that at least some of the particles of the edge filling are incorporated into a board after a single pass through the processing zone, and thus it is mainly new particles that are used for the edge filling during the manufacturing of each board.

According to another aspect of the invention, an apparatus for the continuous manufacture of wood chip boards and similar board materials includes a second spreading device for spreading an edge filling composed of unbonded particles on the edge portion of the bottom forming belt extending from at least one edge of the main filling to the edge region of the bottom forming belt. The apparatus may also contain a moisture control device for adjusting the moisture content of the particles of the edge filling independently of the moisture content of the particles of the main filling. The stock that supplies the particles of the main filling may also supply the particles of the edge filling.

DETAILED DESCRIPTION

Figure 1:
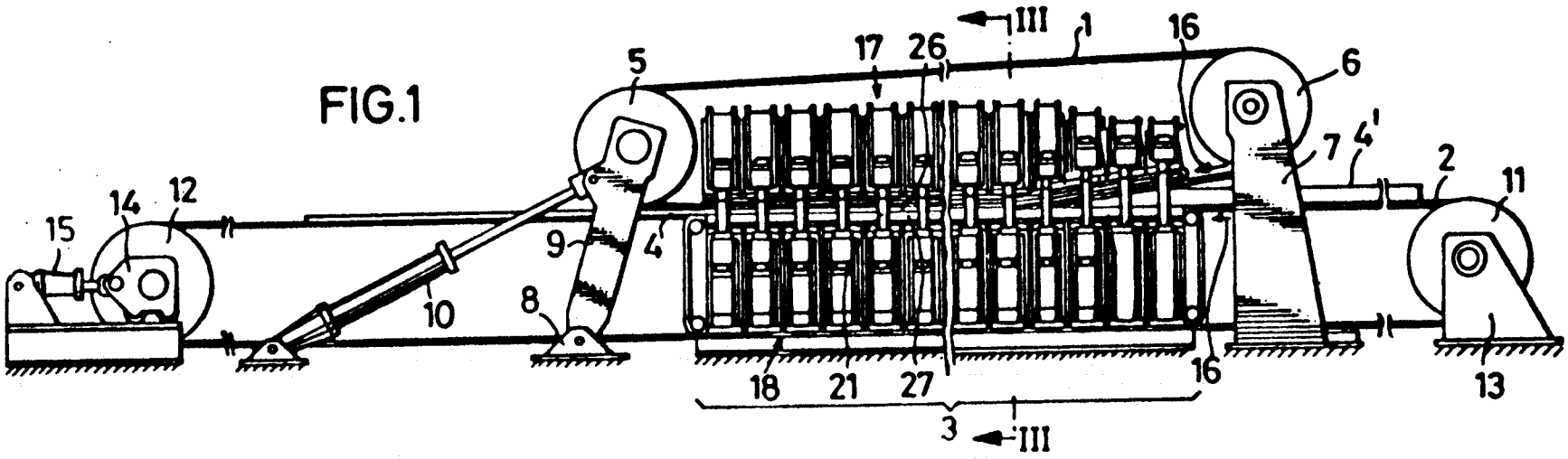
FIG. 1 is a side elevation of a double-belt press of the present invention.

FIG. 1 shows a double-belt press for making wood chip boards, wood fiber boards and other materials in board form from particles bonded by a binder which together are cured under heat and pressure. The double-belt press comprises a top forming belt 1 made of sheet steel of a thickness of about 1 to 1.5 mm, and a similar bottom forming belt 2. The web 4 of a filling 4', which consists of a pourable material, is compressed between the forming belts 1 and 2 in a pressing zone 3. The compression step yields one of the aforementioned materials.

The top forming belt 1 revolves around rollers or drums 5 and 6 disposed transversely of the web 4. Drum 6 is mounted in a stationary upright 7, and drum 5 is mounted in an upright 9 which is pivotable about an axis extending transversely of the web 4 and ends in a bracket 8 on the ground. The upright 9 is moved by hydraulic cylinder 10 in order to place tension on the forming belt 1.

The forming belt 2 revolves around drums 11 and 12 disposed transversely of the web 4. Drum 11 is mounted in a stationary upright 13, while the drum 12 is mounted in an upright 14 which can be moved on rails. The upright 14 can be moved in the longitudinal direction relative to the web by hydraulic cylinder 15 in order to place tension on the forming belt 2. The forming belts 1 and 2 are driven by the drums.

The forming belts 1 and 2 move through the apparatus in the direction indicated by the arrows 16, so that the filling 4', which is applied on the right-hand side of FIG. 1 by a means not shown, is drawn into the pressing zone 3. The compressed web 4 that emerges is removed from the forming belt 2 on the left-hand side of FIG. 1 by a suitable means that is also not shown. A top support structure 17 is provided in the pressing zone 3 within the inner region of the forming belt 1 and it cooperates with a bottom support structure 18 that is provided in the inner region of the bottom forming belt 2. The support structures 17 and 18 brace those areas of the forming belts 1 and 2 which face the web and they press the forming belts 1 and 2 against each other with considerable force.

Figure 2:
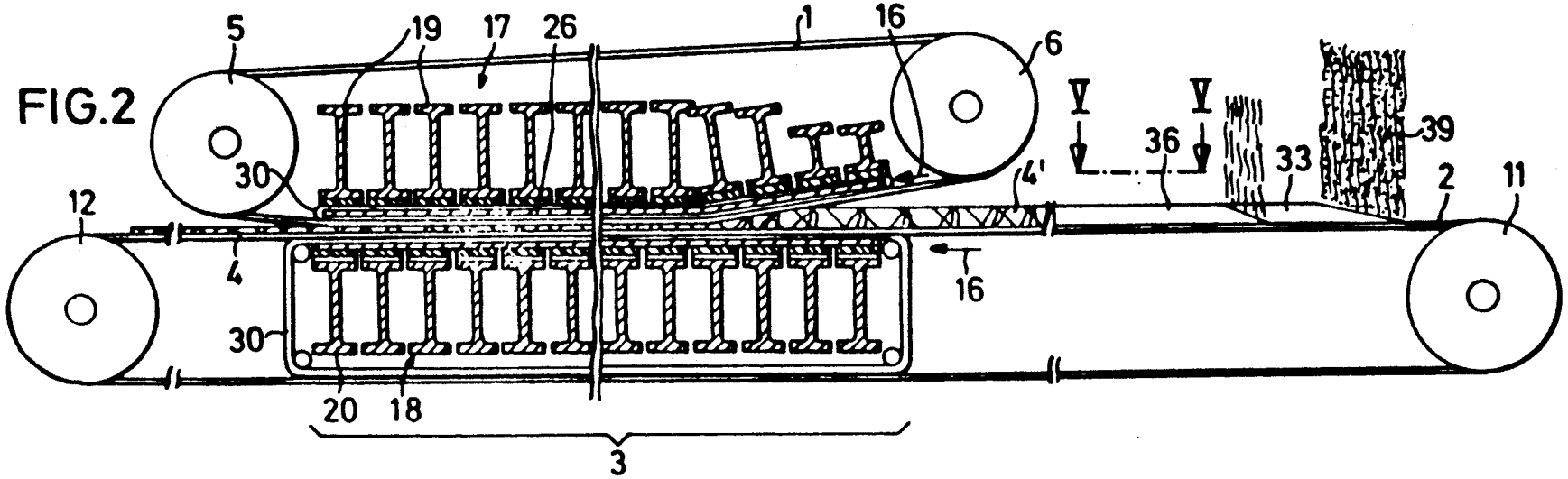
FIG. 2 is a vertical longitudinal section through the double-belt press taken along the line II—II in FIG. 3.
Figure 3:
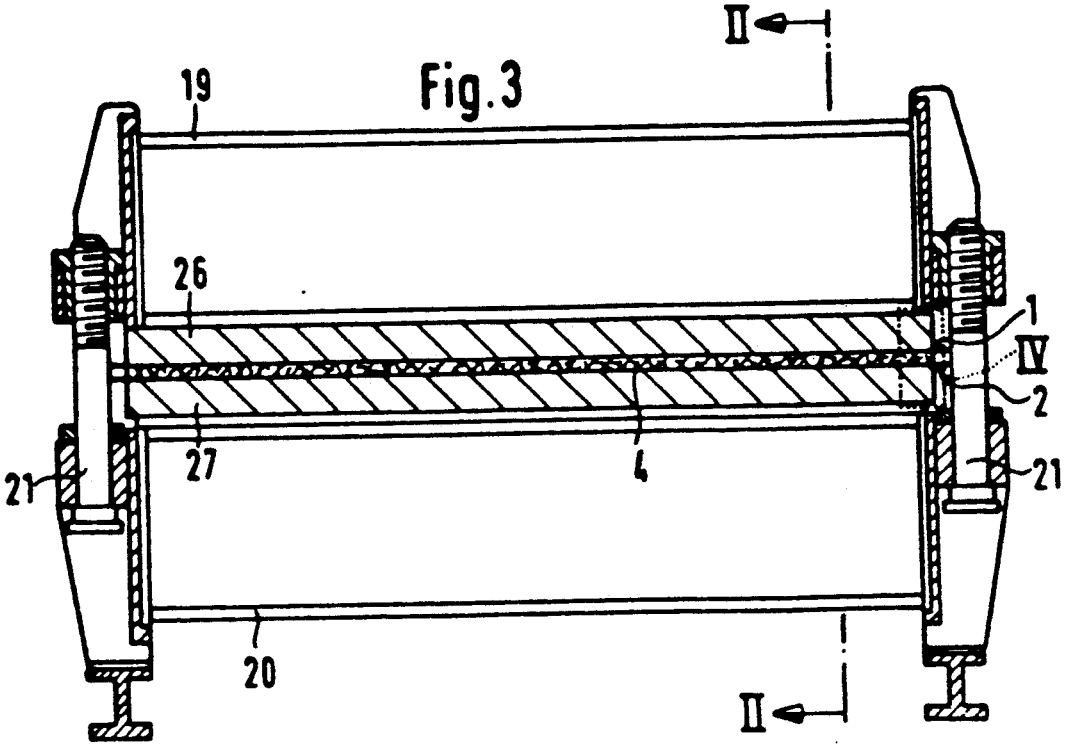
FIG. 3 is a cross-section through the double-belt press taken along the line III—III in FIG. 1.

Each of the support structures 17 and 18 is composed of individual members 19 and 20 each disposed opposite one another above and below the forming belts 1 and 2, respectively, with the web 4 between them, as seen in FIG. 2. As seen in FIG. 3, each pair of members 19 and 20 is clamped by lateral actuators 21 so that individual pressure elements are formed to exert the force.

Figure 4:
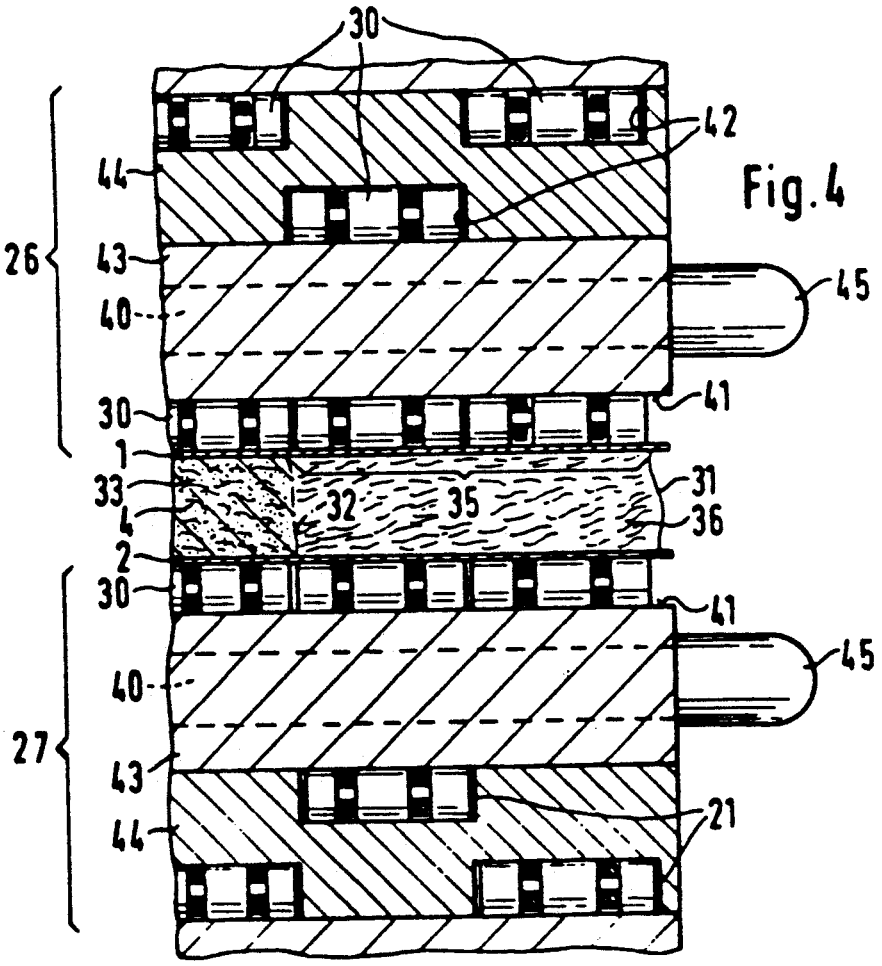
FIG. 4 is a partial cross-section through the edge zone IV in FIG. 3, which is shown as the area enclosed by dashed lines.

Thick plates 26 and 27 are disposed between the members 19 and 20 and the forming belts 1 and 2 which evenly transmit the force exerted by the individual members ;9 and 20 to the forming belts 1 and 2. As seen in FIG. 4, the thick plates 26 and 27 contain ducts 40 in which heater elements are disposed or through which a heating medium is passed.

Roller chains 30 are disposed between the sides of the plates 26 and 27 facing each other and also between the forming belts 1 and 2. The forming belts 1 and 2 roll on the roller chains 30 on the sides of the roller chains 30 opposite the plates 26 and 27. The roller chains 30 continuously revolve in a vertical longitudinal plane around the plates 26 and 27. The rollers of the roller chains 30 transmit both the the heat and pressure from the plates 26 and 27 to the forming belts 1 and 2, which in turn transmit the heat and pressure to the web 4, which is being formed.

Once a given point of the roller chains 30 has reached the end of the longitudinal section 3, it can be returned through the pressing zone itself, i.e. between both the members 19 and 20 and the plates 26 and 27, as shown in FIG. 2 and in FIG. 4, which shows the roller chains 30 being returned through plate 26. This design advantageously allows the roller chains 30 to maintain a substantially constant temperature as they revolve. As an alternative design, the roller chains 30 can be externally guided around the support structure 17 or 18 as seen at the bottom of FIG. 2, where the roller chains 30 are guided around support structure 18.

Referring to FIG. 4, the plates 26 and 27 comprise a heating and support plate 43 and a separate return plate 44 which has return grooves 42 for the roller chains 30. FIG. 4 is a partial cross-section through an edge zone which is located above the web 4 with respect to FIG. 2.

The plates 43 have heating ducts 40, the ends of which are interconnected via return grooves 45 to form a closed pathway. The plates 43 also comprise smooth surfaces 41 which form the rolling surfaces for the roller chains 30 disposed side by side, which are seen in FIG. 4.

When the forming belts 1 and 2 move forward, the roller chains 30 roll between the forming belts 1 and 2 and the smooth surfaces 41 of the plates 43. Adjacent roller chains 30 are situated with their outer end faces parallel to one another.

An essential point with regard to the chain arrangement is that each pair of adjacent roller chains 30 is designed to revolve independently of one another. The support elements for the forming belts 1 and 2 form a bay which is divided into individual lengths in the longitudinal direction. These lengths can move relative to one another in the longitudinal direction in response to stress. Thus, no constraining forces will be created inside the roller chain arrangement due to a varying drive by the forming belts.

Figure 5:
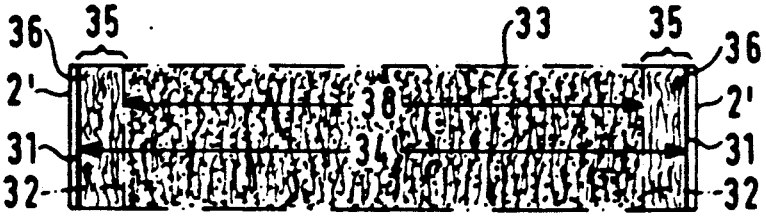
FIG. 5 is a partial top view of the transverse zone of the filling marked V—V in FIG. 2.
Figure 6:
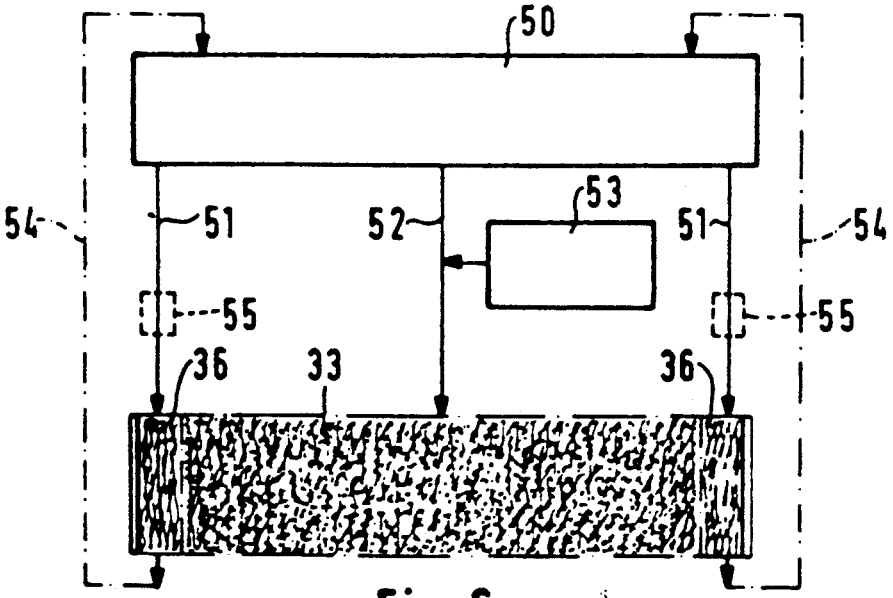
FIG. 6 is a schematic flow diagram of the filling shown in FIG. 5.

When the full working width 34 of the double-belt press is utilized to manufacture board materials, the right-hand edge 31 of the filling and of the board web 4 as seen in FIG. 4 is located essentially at the height of the right-hand edge of the roller chains 30. It is now assumed that it is necessary to manufacture a narrower board web on the same press, with the right-hand edge 32 of the board web, as seen in FIG. 4, located within the rolling zone of the roller chains. A main filling 33 of wood chips or other appropriate particles is placed on the forming belt 2 in a conventional manner. The width 38 of the main filling 33 is less than the nominal working width 34 and is defined by the edge 32 seen in FIG. 4. These wood chips or other particles are provided with a binder, as indicated by the dots drawn in the dropping zone 39 in FIG. 2 and as also indicated in FIGS. 4 to 6.

If the main filling 33 provided with the binder were to enter the pressing zone 3 in the manner stated above, the edge portion 35, which extends from the edge 32 of the main filling 33 to the edge 31 of the pressing zone (FIGS. 4 and 5), would contain no material because the main filling 33 is narrower than the nominal working width 34. The forming belts 1 and 2 would thus lack any counter-pressure in the edge portion 35. For this reason, the heat would be transmitted by the roller chains 30 to the forming belts 1 and 2 much less effectively in the outer edge portion 35 than in the zone where the main filling is located and thus there would be a distinct temperature drop in the edge portion 35 with a corresponding thermal stress in the longitudinal direction.

In order to prevent this temperature drop and the thermal stress, additional edge fillings 36 are applied to the two edge portions 35 of the pressing zone 3 which do not contain the main filling 33. These additional edge fillings 36 provide a counter-pressure on the edge portions 35 which keeps the forming belts 1 and 2 in contact with the roller chains 30 in a manner comparable to that provided by the main filling 33.

The material of the edge filling 36 is the same as that of the main filling 33. They are both taken from the same common stock 50 of unglued chips via conveyors 51 in the case of the material for the edge filling 36, and via conveyer 52 in the case of the material for the main filling 33, as seen in FIG. 6. However, binder is also added to the material for the main filling 33 from the binder stock 53 before the spreading operation takes place in the conveyer zone 52. After passing through the pressing zone 3, the main filling 33 has cured to form the board web 4, while the material of the edge fillings 36, which contains no binder, is still loose and spreadable. Therefore, after leaving the pressing zone, this material can be returned to the stock 50 via the return conveyor 54 and can be mixed with the remainder of the material in the stock 50. It therefore is eventually included in the manufacture of the board web 4 and does not rotate indefinitely as a separate quantity from the material for the main filling 33 simply to supply the edge fillings 36

If required the moisture content of the particles for the edge fillings 36 can be adjusted independently of the moisture content of the particles for the main filling 33 by a moisture control means 55 provided in the conveyer zones 51. For example, this adjustment can lower the moisture content so that the quantity of heat lost at the edge portions 35 as a result of evaporation of moisture is reduced, and thus the required temperature increase of the edge portions 35 can be more easily obtained.

We claim:

1. A method for continuously manufacturing wood chip boards and wood fiber boards composed of particles bonded by a bonding agent, which together form a main filling cured under heat and pressure in a double-belt press having a pressing zone formed between a metal bottom belt for forming the bottom surface of the board material and a metal top belt for forming the top surface of the board material, and a support structure for pressing the belts together wherein the bottom and top metal forming belts rotate in opposite directions to carry particles fed into the double-belt press through the pressing zone, said method comprising the steps of:

a. spreading the main filling on a horizontal portion of the bottom forming belt;

b. spreading an edge filling formed from unbonded particles on an edge portion of the bottom forming belt such that the edge filling extends from at least one edge of the main filling to at least one edge region of the bottom forming belt; and c. transmitting the necessary heat and pressure from the support structure through the bottom and top forming belts to cure the main filling and form a web from which the board materials are made by compressing the main filling and edge filling between the support structure and the bottom and top forming belts.

2. The method of claim 1 wherein the step of spreading the main filling comprises transporting particles from a stock of particles and adding a binder thereto before the main filling is spread onto the bottom forming belt.

3. The method of claim 2 further comprising the step of supplying the particles from which the main filling is formed and the particles from which the edge filling is formed from the stock of particles.

4. The method of claim 3 further comprising the step of returning the particles forming the edge filling after they pass through the pressing zone to the stock of particles.

5. The method of claim 4 further comprising the step of adjusting the moisture content of the particles in the edge filling independently of the moisture content of the particles in the main filling.

6. The method if claim 1 further comprising the step of adjusting the moisture content of the particles in the edge filling independently of the moisture content of the particles in the main filling.

7. A double-belt press for the continuous manufacture of wood chip boards and wood fiber boards composed of particles bonded by a bonding agent, which together are cured under heat and pressure in the press to form the board materials, said press comprising:

a. a top metal, rotatable belt for forming a top surface of the board material;

b. a bottom metal, rotatable belt for forming a bottom surface of the board material, said bottom belt being disposed beneath said top belt to form a pressing zone therebetween in which a pourable material may be conducted for forming a web from which the board materials are made, said bottom belt being adapted to carry the pourable material into the pressing zone;

c. a first means for spreading a main filling of particles and binder onto a horizontal portion of the bottom belt;

d. a second means for spreading an edge filling of unbonded particles on an edge portion of the bottom belt such that the edge filling extends from at least one edge of the main filling to at least one edge region of the bottom forming belt; and e. a support structure bearing against the top and bottom belts for pressing the belts together to compress the main filling and the edge filling, thereby transmitting heat and pressure necessary to cure the main filling and form the web from which the board materials are made.

8. The double-belt press of claim 7 further comprising means for adjusting the moisture content of the particles of the edge filling independently of the moisture content of the particles of the main filling.

9. The double-belt press of claim 7 wherein said first spreading means comprises a first conveyor for transporting particles from a first stock of particles to the horizontal portion of the bottom belt.

10. The double-belt press of claim 9 further comprising means for adding binder to the particles conducted by the first conveyor to the horizontal portion of the bottom belt.

11. The double-belt press of claim 10 wherein said second spreading means comprises a second conveyor for transporting particles from a second stock of particles to the bottom belt.

12. The double-belt press of claim 11 further comprising means for returning the particles of the edge filling after they pass through said pressing zone to said second stock of particles.

13. The double-belt press of claim 12 wherein said first and second stock of particles comprises a common third stock of particles, and said first and second conveyors are operatively connected with said with third stock of particles such that the particles of the main filling and of the edge filling are supplied from said third stock of particles.

14. The double-belt press of claim 13 further comprising means for adjusting the moisture content of the particles of the edge filling independently of the moisture content of the particles of the main filling.

* * * * *

UNITED STATES PATENT AND TRADEMARK OFFICE

CERTIFICATE OF CORRECTION

PATENT NO. : 5,085,812

DATED : February 4, 1992

INVENTOR(S) : Ahrweiler, et. al.

It is certified that error appears in the above-indentified patent and that said Letters Patent is hereby corrected as shown below:

Column 4, line 40, change ";9" to --19--.

Signed and Sealed this

Seventeenth Day of August, 1993

*Attest:*

*Attesting Officer*

BRUCE LEHMAN

*Commissioner of Patents and Trademarks*